US009195178B2

(12) United States Patent
Kosasa

(10) Patent No.: US 9,195,178 B2
(45) Date of Patent: Nov. 24, 2015

(54) ROTARY ENDLESS BELT UNIT FOR USE IN AN IMAGE FORMING APPARATUS AND IMAGE FORMING APPARATUS HAVING SAME

(71) Applicant: CANON KABUSHIKI KAISHA, Tokyo (JP)

(72) Inventor: Hideaki Kosasa, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/323,257

(22) Filed: Jul. 3, 2014

(65) Prior Publication Data

US 2015/0016839 A1 Jan. 15, 2015

(30) Foreign Application Priority Data

Jul. 9, 2013 (JP) ..... 2013-143575

(51) Int. Cl.
*G03G 15/16* (2006.01)

(52) U.S. Cl.
CPC .... *G03G 15/1615* (2013.01); *G03G 2215/0129* (2013.01)

(58) Field of Classification Search
CPC ..... G03G 15/1615; G03G 21/168; G03G 2215/1623; G03G 2221/1642
USPC ..... 399/121, 313
See application file for complete search history.

(56) References Cited

U.S. PATENT DOCUMENTS

| | | | | |
|---|---|---|---|---|
| 4,983,146 | A * | 1/1991 | Charles et al. | 474/117 |
| 6,289,193 | B1 | 9/2001 | Ban et al. | |
| 6,731,895 | B2 * | 5/2004 | Hamada et al. | 399/121 |
| 7,434,680 | B2 * | 10/2008 | Kitamura | 198/806 |
| 7,986,903 | B2 * | 7/2011 | Park | 399/121 |
| 8,146,734 | B2 * | 4/2012 | Shoji | 198/813 |

FOREIGN PATENT DOCUMENTS

| | | |
|---|---|---|
| JP | 2003-167402 A | 6/2003 |
| JP | 2006-151697 A | 6/2006 |

* cited by examiner

*Primary Examiner* — William J Royer
(74) *Attorney, Agent, or Firm* — Fitzpatrick, Cella, Harper & Scinto

(57) ABSTRACT

A belt unit includes an endless belt, a tension roller, at least one extension roller, a first bearing portion supporting a first end of the tension roller such that the first end is movable in a tension direction and is detachably mounted to be able to release the tension force by the first end coming off from the first bearing portion, a second bearing portion supporting a second end of the tension roller to be movable in the tension direction, a first urging portion urging the first end of the tension roller, a second urging portion urging the second end of the tension roller, a first frame portion integrally supporting the first bearing portion, the first urging portion, and the extension roller, and a second frame portion integrally supporting the second bearing portion, the second urging portion, and the tension roller and detachably mounted on the first frame portion.

6 Claims, 8 Drawing Sheets

ROTARY ENDLESS BELT UNIT FOR USE IN AN IMAGE FORMING APPARATUS AND IMAGE FORMING APPARATUS HAVING SAME

BACKGROUND OF THE INVENTION

1. Field of the Invention

The present invention relates to a belt unit used for an image forming apparatus such as a copy machine, a printer, or a facsimile and an image forming apparatus including the belt unit.

2. Description of the Related Art

In general, endless belts such as intermediate transfer belts or secondary transfer belts are used for image forming apparatuses forming images according to an electrophotographic system. As such endless belts, for example, there are known belts built into intermediate transfer belt units so that the belts are extended by extension members such as a plurality of support rollers and cleaning counter rollers and cleaning blades come into contact with the outer peripheral surfaces thereof.

For example, as disclosed in JP-A-2006-151697, an intermediate transfer belt unit includes a pressure roller pressurizing an intermediate transfer belt from the outer peripheral side, and a tension force on the intermediate transfer belt is released by lifting up the entire belt unit at the time of belt exchange, so that the intermediate transfer belt is extracted from the extension members to be exchanged.

As disclosed in JP-A-2003-167402, an intermediate transfer belt is configured to be built in a support frame and a belt unit is designed to be downsized by setting the support frame as a plurality of unit bodies separable in a direction intersecting a direction of conveyance of the intermediate transfer belt and providing a bending point on a valley side to be bent in a direction in which the entire outer periphery of the support frame is smaller than the inner periphery of an endless belt.

However, for example, when an endless belt with a small diameter is extended by a plurality of extension rollers, it is difficult to slacken the belt so that the intermediate transfer belt is exchanged even when the tension force on the intermediate transfer belt is released by lifting up the entire belt unit or the belt support frame including the extension rollers is separated and bent, as described above. For this reason, it is necessary to separate the extension rollers from support members, and thus there is a problem in that it takes considerable time to exchange the intermediate transfer belt.

This problem is not limited only to the intermediate transfer belt, but also is common to a secondary transfer belt configured to transfer a toner image to a recording medium passed to be conveyed between an image carrier of an intermediate transfer belt or the like and the secondary transfer belt when the recording medium comes into contact with the image carrier. Therefore, the foregoing problem may be more conspicuous in such a secondary transfer belt with a small diameter.

SUMMARY OF THE INVENTION

According to an aspect of the invention, there is provided a belt unit including a rotary endless belt, a tension roller extending the endless belt and applying a tension force to the endless belt, at least one extension roller extending the endless belt with the tension roller, a first bearing portion supporting a first end of the tension roller such that the first end is movable in a tension direction and is detachably mounted to be able to release the tension force by the first end coming off from the first bearing portion, a second bearing portion supporting a second end of the tension roller to be movable in the tension direction, a first urging portion urging the first end of the tension roller and generating the tension force, a second urging portion urging the second end of the tension roller and generating the tension force, a first frame portion integrally supporting the first bearing portion, the first urging portion, and the extension roller, and a second frame portion integrally supporting the second bearing portion, the second urging portion, and the tension roller and detachably mounted on the first frame portion.

Further features of the present invention will become apparent from the following description of exemplary embodiments with reference to the attached drawings.

DESCRIPTION OF THE EMBODIMENTS

Figure 1:
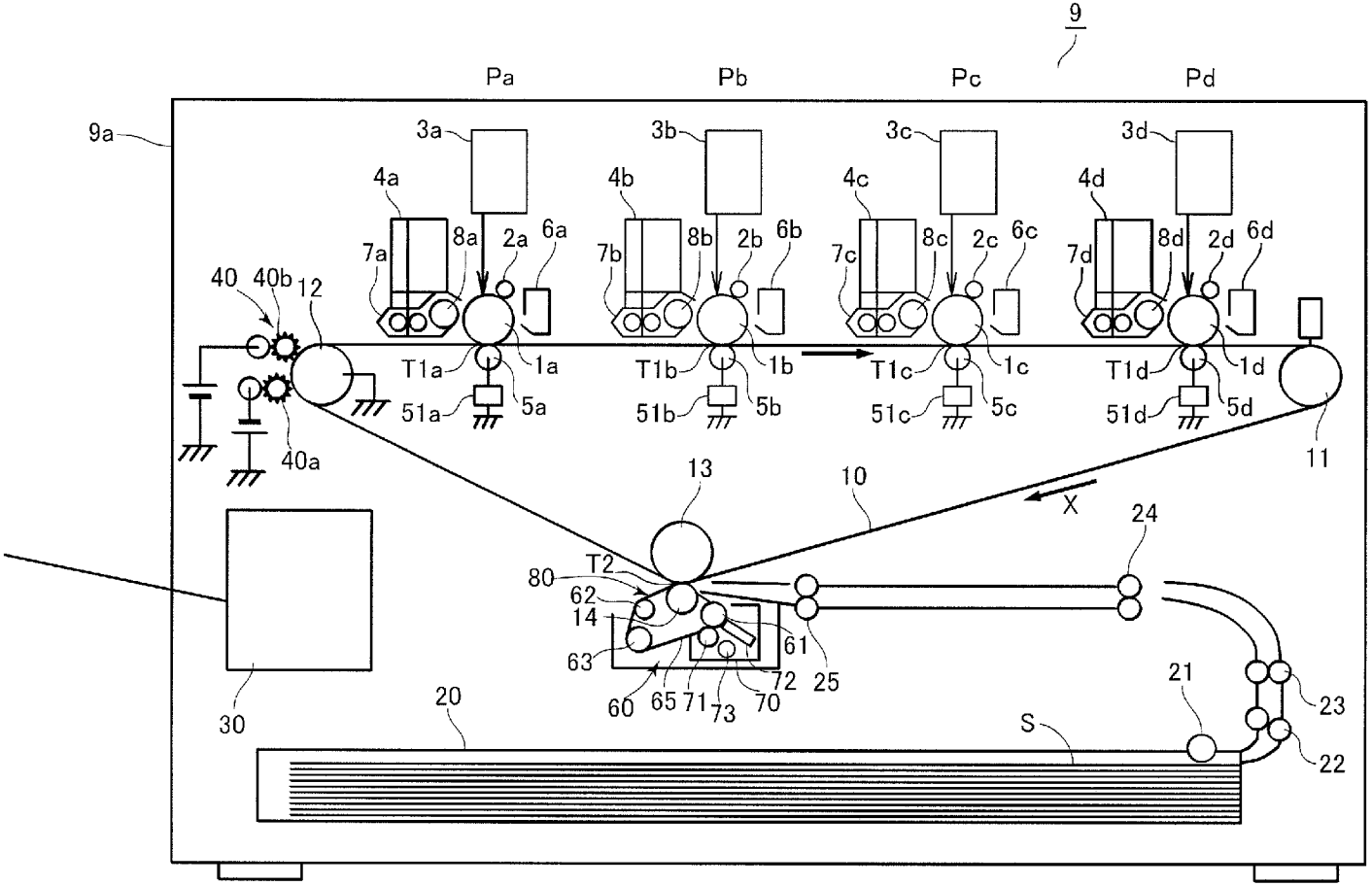
FIG. 1 is a cross-sectional view illustrating the configuration of an image forming apparatus according to an embodiment of the invention.

Hereinafter, an embodiment of the invention will be described with reference to the drawings. The dimensions, materials, shapes, relative positions, and the like of constituent elements of an image forming apparatus are not intended to limit the scope of the invention unless particularly otherwise mentioned. Further, constituent elements denoted by the same reference numerals in the drawings have the same configurations or operations and repeated description thereof will be properly omitted.

<Image Forming Apparatus>

FIG. 1 is a cross-sectional view illustrating a schematic configuration of a color image forming apparatus of a tandem system according to the embodiment. As illustrated in FIG. 1, an image forming apparatus 9 includes an apparatus body 9*a*. Inside the apparatus body 9*a*, an intermediate transfer belt 10 is provided as an intermediate transfer body having a peripheral length L and rotating and running in a direction indicated by an arrow X at a speed V mm/s. The intermediate transfer belt 10 is wound to be extended by a drive roller 11, a tension roller 12, and a secondary transfer inner-roller 13 which are extension members.

Four image forming portions P (Pa, Pb, Pc, and Pd) forming toner images are disposed in series along a horizontal portion on the upper side of the intermediate transfer belt 10. The image forming portions P (Pa to Pd) have substantially the same configuration and form toner images of yellow (Y), magenta (M), cyan (C), and black (K), respectively.

On the lower part of the apparatus body 9*a*, a sheet feed cassette 20 accommodating a recording medium (sheet) S and a sheet feed roller 21 feeding and sending the recording medium S from the sheet feed cassette 20 are disposed. Further, pairs of conveyance rollers 22, 23, and 24 are disposed which convey the recording medium S fed and sent by the sheet feed roller 21 downstream and a pair of resist rollers 25 are disposed which correct a skew of the recording medium S and feed the recording medium S into a secondary transfer portion T2 based on a timing of toner images on the intermediate transfer belt 10.

The secondary transfer portion T2 has a secondary transfer outer-roller 14 facing the secondary transfer inner-roller 13 coming into contact with the inner peripheral surface of the intermediate transfer belt 10 and pinching the intermediate transfer belt 10 along with the secondary transfer inner-roller 13. A secondary transfer unit 60 including the secondary transfer outer-roller 14 is disposed below the secondary transfer inner-roller 13.

The secondary transfer unit 60 includes a secondary transfer belt 65 which is an endless belt extended by the secondary transfer outer-roller 14, a tension roller 63, and extension rollers 61 and 62 to be rotated. The tension roller 63 extends the secondary transfer belt 65 and imparts a tension force to the secondary transfer belt 65. The extension rollers 61 and 62 extend the secondary transfer belt 65 along with the tension roller 63. In the embodiment, the two extension rollers 61 and 62 are used as the extension rollers. In the invention, however, a function is achieved when at least one extension roller is provided.

By applying a transfer bias voltage to the secondary transfer inner-roller 13, the toner images of four colors on the intermediate transfer belt 10 are secondarily transferred to the recording medium S fed via the pair of resist rollers 25. On the downstream side of the secondary transfer portion T2, a fixing unit 30 is disposed which performs fixing by heating and pressurizing the recording medium S to which the toner images are secondarily transferred by the secondary transfer portion T2 and which is conveyed.

Hereinafter, the image forming portion Pa will be described. The image forming portion Pa includes an electrographic photosensitive member (hereinafter referred to as a photoconductive drum) 1*a* with a drum shape which is an image carrier disposed to be rotatable. Process units such as a primary charge roller 2*a* which is a primary charger, an exposure unit 3*a*, a developing unit 4*a*, a primary transfer roller 5*a* which is a primary transferor, and a cleaning unit 6*a* are disposed in the periphery of the photoconductive drum 1*a*.

The image forming portions Pb, Pc, and Pd other than the image forming portion Pa have the same configuration as the image forming portion Pa. That is, the image forming portions Pb to Pd include photoconductive drums 1*b*, 1*c*, and 1*d*, primary charge rollers 2*b*, 2*c*, and 2*d*, exposure units 3*b*, 3*c*, and 3*d*, developing units 4*b*, 4*c*, and 4*d*, primary transfer rollers 5*b*, 5*c*, and 5*d*, and cleaning units 6*b*,6*c*, and 6*d*, respectively.

The image forming portions Pa, Pb, Pc, and Pd differ from each other in that the image forming portions Pa, Pb, Pc, and Pd form toner images of yellow, magenta, cyan, and black, respectively. The developing units 4*a*, 4*b*, 4*c*, and 4*d* disposed in the image forming portions Pa, Pb, Pc, and Pd accommodate yellow toner (yellow developer), magenta toner (magenta developer), cyan toner (cyan developer), and black toner (black developer), respectively.

Next, an operation of the image forming apparatus 9 having the foregoing configuration will be described. That is, in the image forming portion Pa, the photoconductive drum la is uniformly charged by the primary charge roller 2*a*, a laser beam according to an image signal by a yellow component color of a document is projected from the exposure unit 3*a* to the photoconductive drum 1*a* via a polygon mirror or the like, and an electrostatic latent image is formed. Subsequently, the yellow toner is supplied from the developing unit 4*a* and the electrostatic latent image is visualized as a yellow toner image on the photoconductive drum 1*a*.

In association with the rotation of the photoconductive drum 1*a*, the yellow toner image reaches a primary transfer portion T1*a* which is a transfer nip portion in which the photoconductive drum 1*a* and the intermediate transfer belt 10 come into contact with each other. In the embodiment, a primary transfer bias is applied in the primary transfer portion T1*a* when the primary transfer roller 5*a* comes into contact with the inner peripheral surface of the intermediate transfer belt 10. Then, the yellow toner image on the photoconductive drum 1*a* is primarily transferred to the outer peripheral surface of the intermediate transfer belt 10.

The intermediate transfer belt 10 carrying the yellow toner image is rotated and moved to the subsequent image forming portion Pb. In the image forming portion Pb, according to the foregoing same method, a magenta toner image formed on the photoconductive drum lb is primarily transferred to be superimposed on the yellow toner image on the intermediate transfer belt 10 in a primary transfer portion T1*b* in which the primary transfer roller 5*b* comes into contact with the photoconductive drum 1*b*.

Likewise, as the intermediate transfer belt 10 progresses to the image forming portions Pc and Pd along the direction indicated by the arrow X, cyan and black toner images are primarily transferred to be superimposed on the toner images on the intermediate transfer belt 10 in primary transfer portions T1*c* and T1*d* in which the primary transfer rollers 5*c* and 5*d* come into contact with the photoconductive drums 1*c* and 1*d*.

Until this time, the recording medium S conveyed from the sheet feed cassette 20 by the sheet feed roller 21 and the pairs of conveyance rollers 22, 23, and 24 is fed into the secondary transfer portion T2 based on a timing of the toner images on the intermediate transfer belt 10. The recording medium S to which the toner images are secondarily transferred is further conveyed to the fixing unit 30, and then is heated and pressurized so that the toner images are fixed by the fixing unit 30.

The toner failed to be primarily transferred in the primary transfer portions T1 (T1*a*, T1*b*, T1*c*, and T1*d*) and remaining on the photoconductive drums 1 (1*a*, 1*b*, 1*c*, and 1*d*) is cleaned by the cleaning units 6 (6*a*, 6*b*, 6*c*, and 6*d*).

The toner failed to be secondarily transferred in the secondary transfer portion T2 and remaining on the intermediate transfer belt 10 is cleaned by an intermediate transfer belt cleaning unit 40 to be supplied in subsequent image forming. The intermediate transfer belt cleaning unit 40 includes an upstream cleaning portion 40*a* and a downstream cleaning portion 40*b*.

Next, a detailed configuration of each unit will be described. First, the photoconductive drums 1 (1*a*, 1*b*, 1*c*, and 1*d*) serving as the image carriers are configured by applying an organic photoconductive layer (OPC) to the outer peripheral surface of an aluminum cylinder with a diameter of, for example, 80 mm. Both ends of each photoconductive drum 1 in an axial direction are supported by flanges (not illustrated) to be rotatable, and thus each photoconductive drum 1 is driven to be rotatable in a counterclockwise rotation direction in FIG. 1 by transmitting a drive force from a drive motor (not illustrated) to one end.

The primary charge rollers 2 (2*a*, 2*b*, 2*c*, and 2*d*) configured by conductive rollers each come into contact with the surface of the photoconductive drum 1 and a charge bias voltage is applied by a power source (not illustrated) so that the surface of the photoconductive drum 1 is uniformly charged with a negative polarity.

In the embodiment, the exposure units 3 (3*a*, 3*b*, 3*c*, and 3*d*) are each controlled according to an image signal by a drive circuit (not illustrated) by radiating a laser beam via a polygon mirror (not illustrated).

The developing units 4 (4*a*, 4*b*, 4*c*, and 4*d*) include toner accommodation portions 7 (7*a*, 7*b*, 7*c*, and 7*d*) accommodating color toners of yellow, magenta, cyan, and black with negative charge characteristics, respectively. The developing units 4 further include developing rollers 8 (8*a*, 8*b*, 8*c*, and 8*d*) adjacent to the surface of the photoconductive drums 1 and performing developing by applying a developing bias voltage by a developing bias power source (not illustrated). In the embodiment, as described above, the toner accommodation portions 7 accommodate the color toners of yellow, magenta, cyan, and black in order from the upstream side of the rotation direction of the intermediate transfer belt 10.

In the inside of the intermediate transfer belt 10, the primary transfer rollers 5 (5*a*, 5*b*, 5*c*, and 5*d*) are provided which are disposed to face the photoconductive drums 1*a*, 1*b*, 1*c*, and 1*d*, respectively, and come into contact with the intermediate transfer belt 10. Transfer bias power sources (power sources) 51 (51*a*, 51*b*, 51*c*, and 51*d*) are connected to the primary transfer rollers 5*a* to 5*d*, respectively. A voltage with a positive polarity is applied to each of the primary transfer rollers 5*a* to 5*d*. Due to the electric fields, the color toner images with a negative polarity on the photoconductive drums 1 are sequentially transferred to the intermediate transfer belt 10 coming into contact with the photoconductive drums 1, so that color images are formed.

Figure 2:
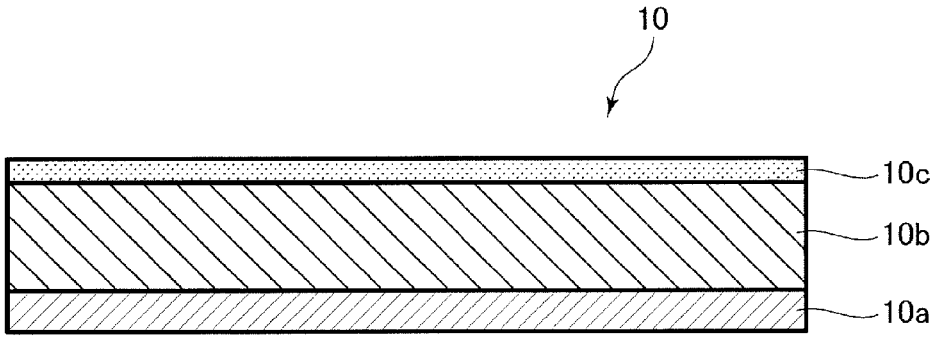
FIG. 2 is a cross-sectional view illustrating the configuration of an intermediate transfer belt according to the embodiment.

In the embodiment, the intermediate transfer belt 10 is configured as an endless elastic intermediate transfer belt and has a 3-layered structure of a resin layer 10*a*, an elastic layer 10*b*, and a surface layer 10*c*, as illustrated in the cross-sectional view of FIG. 2.

As illustrated in FIG. 1, the color images primarily transferred to the intermediate transfer belt 10 in the primary transfer portions T1 are secondarily transferred to the recording medium S in the secondary transfer portion T2 in which the secondary transfer outer-roller 14 serving as a secondary transfer portion comes into contact with the intermediate transfer belt 10 with the secondary transfer belt 65 interposed therebetween.

The secondary transfer inner-roller 13 is connected to a transfer bias power source (not illustrated) and a voltage with a negative polarity is applied from the secondary transfer inner-roller 13. Due to an electric field caused by the voltage, the toner images with the negative polarity on the intermediate transfer belt 10 are secondarily transferred sequentially to the recording medium S coming into contact with the intermediate transfer belt 10, so that the color images are formed on the recording medium S. In the embodiment, the secondary transfer outer-roller 14 is configured to include three layers, i.e., a lower layer made of sponge rubber, an intermediate layer made of solid rubber, and a surface layer coated with fluorine (not illustrated).

<Secondary Transfer Unit>

Figure 3:
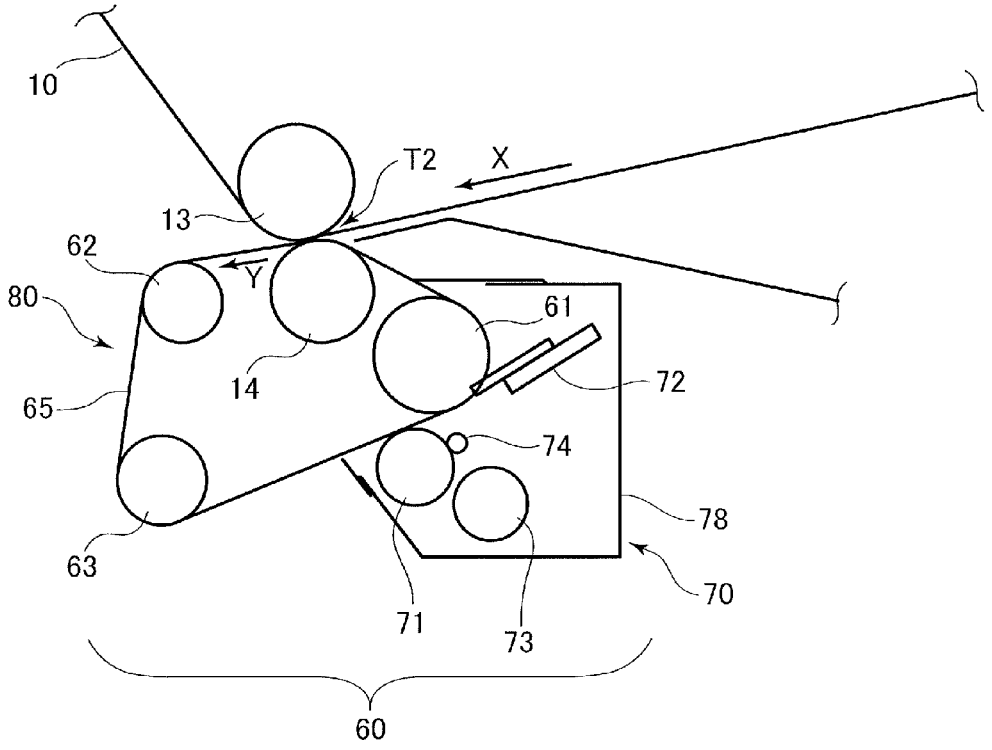
FIG. 3 is an expanded cross-sectional view schematically illustrating a secondary transfer unit according to the embodiment.

Next, the secondary transfer unit 60 which has the characteristics of the invention will be described with reference to FIGS. 3 to 8B. FIG. 3 is an expanded cross-sectional view schematically illustrating the secondary transfer unit 60.

In the secondary transfer unit 60, as illustrated in FIG. 3, the secondary transfer belt 65 is wound around the secondary transfer drive roller (hereinafter referred to as an extension roller) 61, the secondary transfer outer-roller 14, the separation roller (hereinafter referred to as an extension roller) 62, and the tension roller 63 to be extended. The secondary transfer belt 65 is configured as a polyimide resin belt. In FIG. 3, an arrow X indicates the rotating direction of the intermediate transfer belt 10 and an arrow Y indicates a turning direction of the secondary transfer belt 65.

A secondary transfer belt cleaner 70 disposed to face the outer peripheral surface of the secondary transfer belt 65 and cleaning the surface of the secondary transfer belt 65 is provided on the downstream side of the secondary transfer belt 65 in the rotating direction Y. The secondary transfer belt cleaner 70 includes a casing 78 and includes a far roller 71, a cleaning blade 72, a collected toner conveyance screw 73, and a scraper shaft 74 inside the casing 78.

The far roller 71 is configured as a conductive metal roller and nylon fibers are implanted on the metal roller, and the far roller 71 is disposed so that an intrusion amount of about 1 mm into the secondary transfer belt 65 is maintained and sliding contact is possible. The scraper shaft 74 is disposed to come into contact with the far roller 71.

The cleaning blade 72 is made of urethane rubber and comes into pressure contact with the secondary transfer belt 65 at a predetermined contact angle and contact pressure.

In the foregoing configuration, when the toner images are secondarily transferred to the recording medium S, sheet powders attached to the secondary transfer belt 65 are removed by the far roller 71 and the sheet powders attached to the far roller 71 are scraped off by the scraper shaft 74.

The toner failed to be transferred and attached to the secondary transfer belt 65 is removed by the rotating of the secondary transfer belt 65 and the operation of the cleaning blade 72 and is discharged to a collected toner collecting portion (not illustrated) together with the sheet powders removed by the far roller 71 by the collected toner conveyance screw 73.

Figure 4:
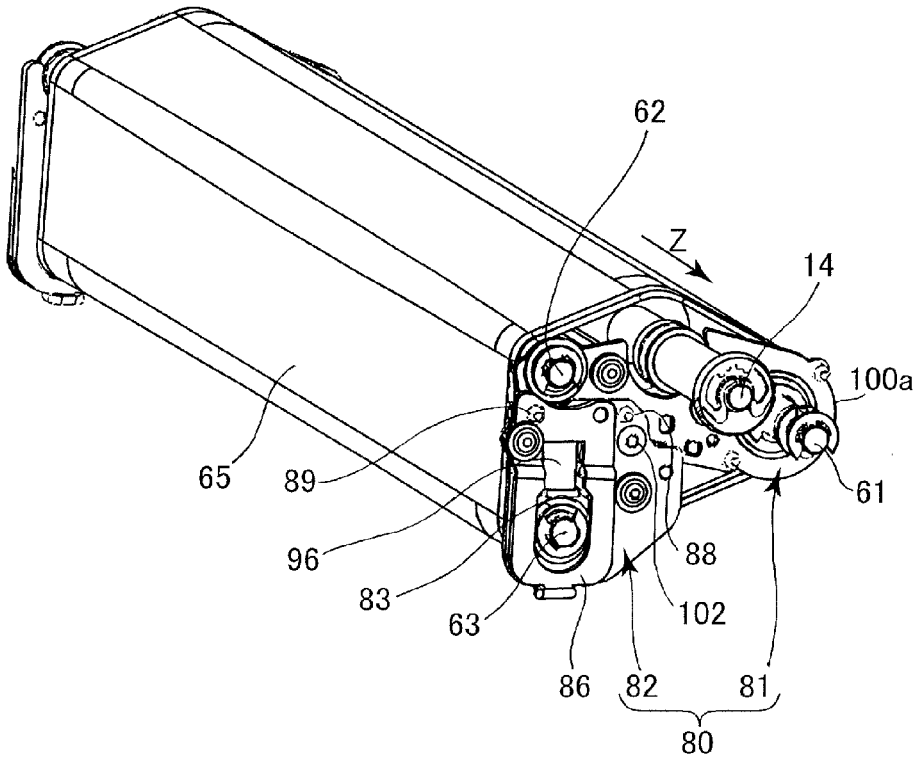
FIG. 4 is a perspective view illustrating a secondary transfer belt unit of the secondary transfer unit.
Figure 5:
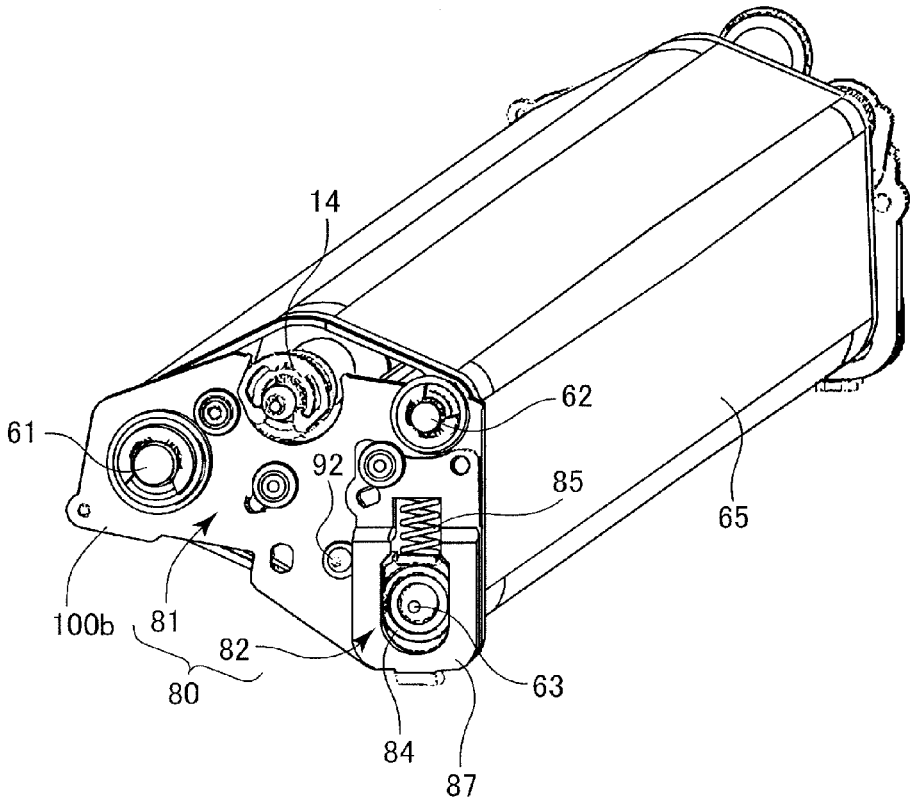
FIG. 5 is a perspective view illustrating the secondary transfer belt unit when viewed from the opposite side to FIG. 4.
Figure 6:
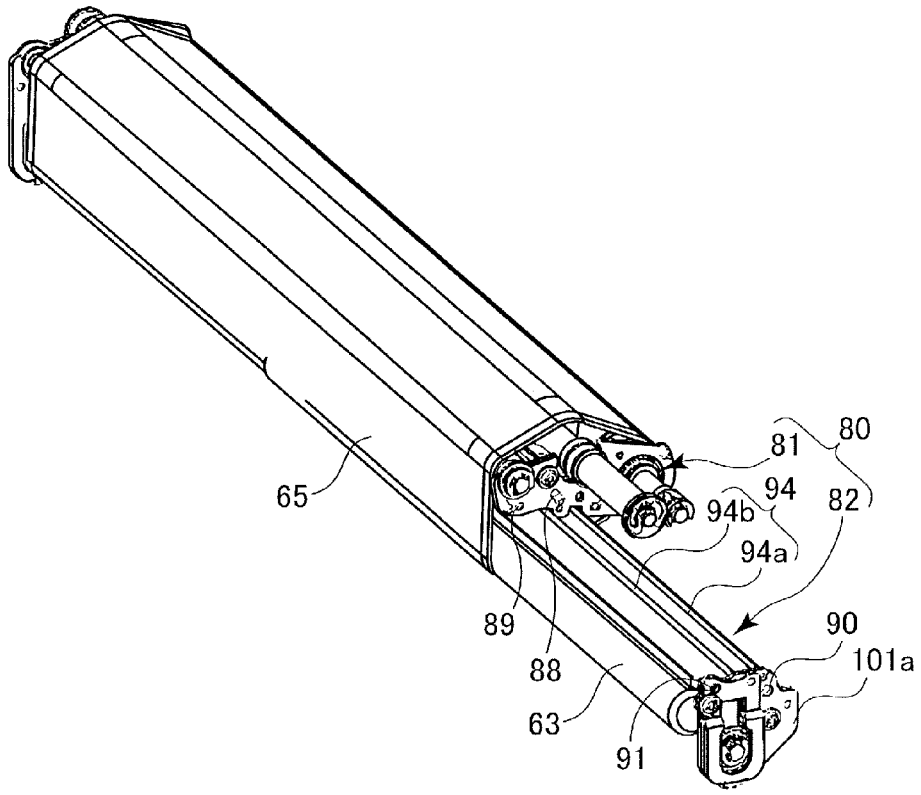
FIG. 6 is a perspective view illustrating an extraction or insertion state of the secondary transfer belt unit.
Figure 7A:
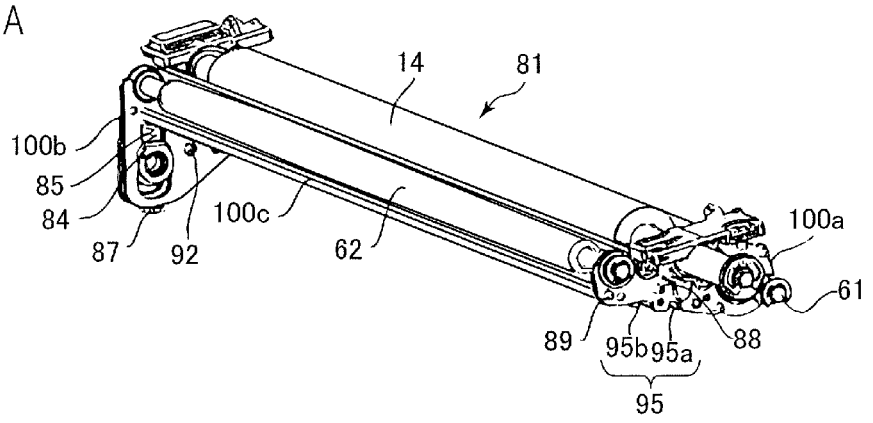
FIG. 7A is a perspective view illustrating an extension roller unit of the secondary transfer belt unit.
Figure 7B:
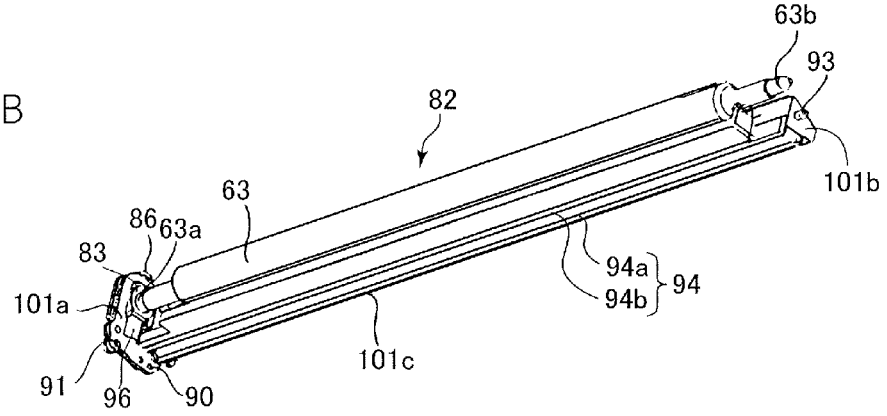
FIG. 7B is a perspective view illustrating a tension roller unit of the secondary transfer belt unit.
Figure 7C:
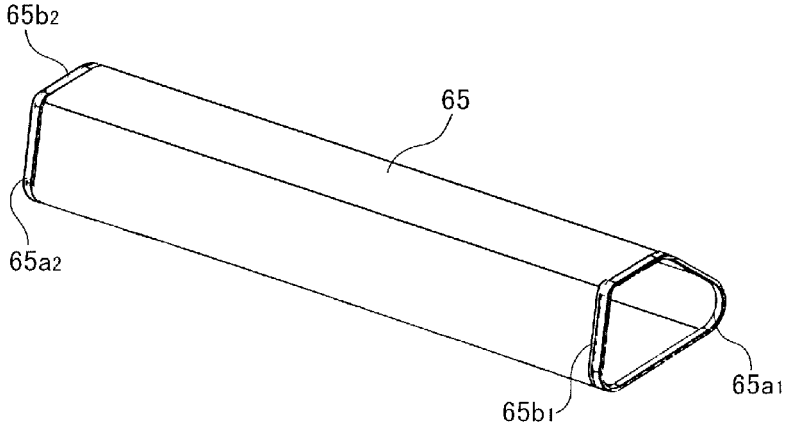
FIG. 7C is a perspective view illustrating a secondary transfer belt of the secondary transfer belt unit.
Figure 8A:
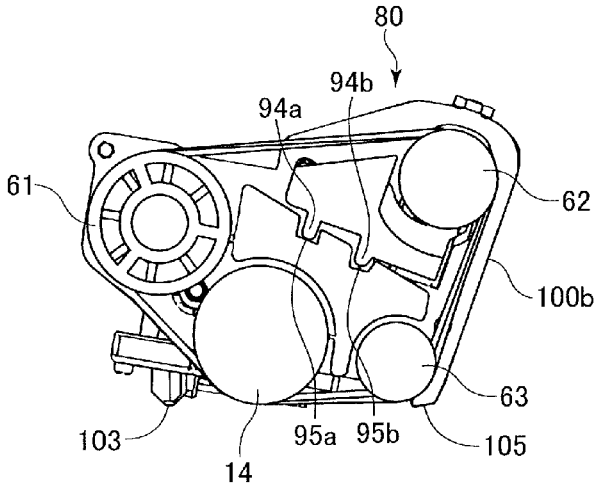
FIG. 8A is a cross-sectional view taken along the line W-W of FIG. 8B when viewed in an arrow direction.
Figure 8B:
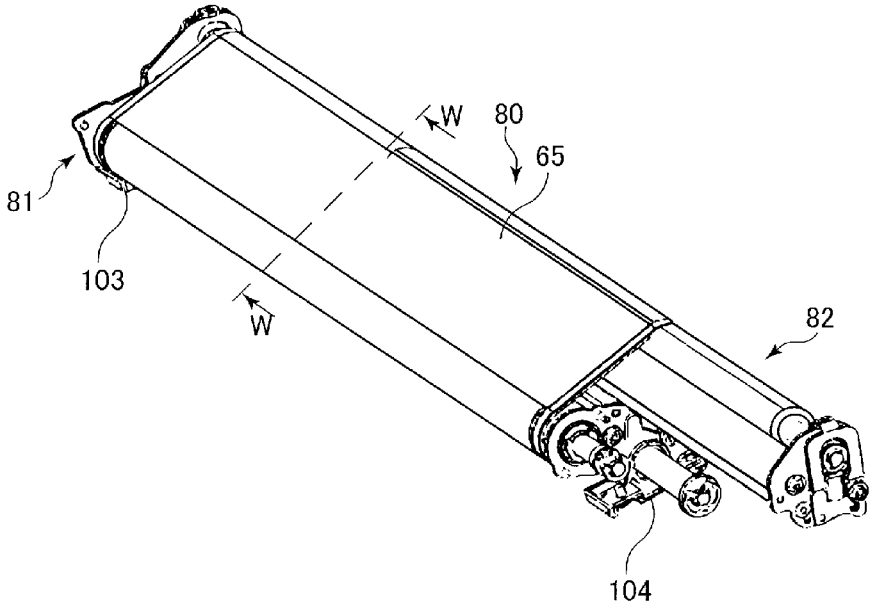
FIG. 8B is a perspective view illustrating the secondary transfer belt unit when viewed obliquely from the above.

Next, a secondary transfer belt unit 80 in the secondary transfer unit 60 will be described in detail with reference to FIGS. 4 to 8B. FIG. 4 is a perspective view illustrating the secondary transfer belt unit 80 of the secondary transfer unit 60. FIG. 5 is a perspective view illustrating the secondary transfer belt unit 80 when viewed from the opposite side to FIG. 4. FIG. 6 is a perspective view illustrating an extraction or insertion state of the secondary transfer belt unit 80. FIGS. 7A to 7C illustrate constituent elements of the secondary transfer belt unit 80. FIG. 7A is a perspective view of an extension roller unit 81, FIG. 7B is a perspective view of a tension roller unit 82, and FIG. 7C is a perspective view of the secondary transfer belt 65. FIGS. 8A and 8B illustrate the secondary transfer belt unit 80. FIG. 8A is a cross-sectional view taken along the line W-W of FIG. 8B and FIG. 8B is a perspective view when viewed obliquely from the above.

As illustrated in FIG. 4, the secondary transfer belt unit 80 serving as a belt unit includes the secondary transfer belt 65, the extension roller unit 81 serving as a first roller unit, and the tension roller unit 82 serving as a second roller unit. The secondary transfer belt unit 80 configures a transfer belt unit transferring the toner images to the recording medium S from the image forming portions P (Pa, Pb, Pc, and Pd) and is configured to be detachably mounted on the secondary transfer unit 60 (see FIG. 3). The extension roller unit 81 and the tension roller unit 82 are connected to each other by a screw 102 serving as a fastening member and positioning pins 88 and 89.

As illustrated in FIG. 5, the extension roller unit (first roller unit) 81 includes a bearing 84 serving as a first bearing portion, a tension spring 85 serving as a first urging portion, a unit housing 100 (100*a*, 100*b*, and 100*c*) serving as a first frame portion, and the extension rollers 61 and 62 and integrally supports the bearing 84, the tension spring 85, and the extension rollers 61 and 62 via the unit housing 100. The tension roller unit (second roller unit) 82 integrally supports a bearing 83 (see FIG. 4) serving as a second bearing, a tension spring 96 (see FIG. 7B) serving as a second urging portion, and the tension roller 63 and is configured to be detachably mounted on the extension roller unit 81.

In the extension roller unit 81, as illustrated in FIG. 7A, the extension rollers 61 and 62 and the secondary transfer outer-roller 14 are supported by the unit housing 100 (100*a*, 100*b*, and 100*c*) to be rotatable, respectively.

The extension rollers 61 and 62 and the secondary transfer outer-roller 14 are fixed and disposed with high accuracy at predetermined positions in the unit housing 100 (100*a*, 100*b*, and 100*c*) respectively. This is because there is an influence on a running performance of the secondary transfer belt 65, a position accuracy of a secondarily transferred image, separation of the recording medium S from the secondary transfer belt 65, and a delivery performance of the recording medium S to a downstream unit (conveyance section to the fixing unit 30) (not illustrated).

The tension roller unit 82 is positioned and fixed to the unit housing 100*a* (an anterior side-surface portion) serving as a first support member in the unit housing 100 via the screw 102 and the positioning pins 88 and 89. Further, a tension mechanism operating to a posterior end (first end) 63*b* (see FIG. 7B) of the tension roller 63 and imparting a tension force to the secondary transfer belt 65 is provided in the unit housing 100*b* (posterior side-surface portion). The anterior side-surface portion (first support member) 100*a* is included in the extension roller unit 81 and supports ends of the extension rollers 61 and 62 opposite to the bearing 84.

The tension spring (first urging portion) 85, the bearing (first bearing portion) 84, and a bearing-falling-prevention member 87 fixed to the posterior side-surface portion 100*b* are disposed as the tension mechanism. Further, a fitting hole 92 fitted to a posterior positioning portion 93 of the tension roller unit 82 is provided.

The bearing (first bearing portion) 84 supports the posterior end 63*b* serving as the first end of the tension roller 63 to be detachably mounted and movable in a tension direction in which a tension force is imparted, and releases the tension force when the posterior end 63*b* is separated. The tension spring (first urging portion) 85 urges the posterior end 63*b* serving as the first end of the tension roller 63 so that a tension force is generated.

On a surface of the unit housing 100*c* (rectangular portion) of the unit housing 100 opposite to the tension roller unit 82, guide groove portions 95 (95*a* and 95*b*) serving as a first guide portion are formed from the anterior side-surface portion 100*a* to the posterior side-surface portion 100*b* (see FIG. 8A). The guide groove portion (first guide portion) 95 is included in the extension roller unit 81 and is provided along the axial direction of the extension rollers 61 and 62.

As illustrated in FIG. 8A, the guide groove portions 95 (95*a* and 95*b*) are paired with guide ribs 94 (94*a* and 94*b*) serving as a second guide portion on the side of the tension roller unit 82 in FIG. 7B. The guide ribs (second guide portion) 94*a* and 94*b* are guided along the guide groove portions (first guide portion) 95*a* and 95*b*, respectively, when the guide ribs 94*a* and 94*b* are provided in the tension roller unit 82.

On the other hand, as illustrated in FIG. 7B, the tension roller unit 82 includes a unit housing 101 (101*a*, 101*b*, and 101*c*) serving as a second frame portion, a tension spring 96 serving as a second urging member urging an anterior end (second end) 63*a* of the tension roller 63, and a bearing (second bearing portion) 83 supporting the anterior end 63*a* of the tension roller 63 to be movable in an urging direction (a vertical direction in FIG. 4) of the tension spring 96, and integrally supports the tension spring 96, the bearing 83, and the tension roller 63 via the unit housing 101. That is, in the tension roller unit 82, the tension roller 63 is supported to be rotatable by the bearing (second bearing portion) 83 (see FIG. 4) with respect to the unit housing 101. The bearing 83 is prevented from falling with respect to the unit housing 101 by a bearing-falling-prevention member 86 fixed to the unit housing 101*a* (anterior side-surface portion) to be supported.

The tension spring (second urging portion) 96 serving as a tension mechanism imparting a tension force to the secondary transfer belt 65 is disposed in the anterior side-surface portion 101*a* serving as a second support member in the unit housing 101. The tension spring 85 operates the tension force to the bearing (second bearing portion) 83 via the anterior end 63*a* of the tension roller 63. The anterior side-surface portion (second support member) 101*a* is included in the tension roller unit 82, can be detachably mounted with the anterior side-surface portion (first support member) 100*a*, and supports the anterior end (second end) 63*a* of the tension roller 63.

The bearing (second bearing portion) 83 supports the anterior end 63*a* serving as the second end of the tension roller 63 to be movable in the tension direction. The tension spring (second urging portion) 96 urges the anterior end 63*a* serving as the second end of the tension roller 63 to generate a tension force.

Positioning holes 90 and 91 fitted with the positioning pins 88 and 89 (see FIG. 7A) of the extension roller unit 81 are provided in the anterior side-surface portion 101*a*. The posterior portion 93 which can be fitted into the fitting hole 92 of the unit housing 101*b* (posterior side-surface side) is provided in the posterior side-surface side 101*b*. The guide ribs 94 (94*a* and 94*b*) are provided on the surface of the unit body 101*c* (rectangular portion) opposite to the extension roller unit 62.

As illustrated in FIG. 7C, ribs $\mathbf{65}a_1$ and $\mathbf{65}a_2$ are formed in the inner peripheral surfaces of both end portions $\mathbf{65}b_1$ and $\mathbf{65}b_2$ of the secondary transfer belt 65 respectively. The secondary transfer belt 65 functions so as not to be separated from the roller units 81 and 82 by operations of the ribs $\mathbf{65}a_1$ and $\mathbf{65}a_2$ when the secondary transfer belt 65 is assembled to be extended by the extension roller unit 81 and the tension roller unit 82.

The secondary transfer belt unit 80 having the above-described configuration operates as follows. That is, when the secondary transfer belt 65 which is an endless belt with a small diameter is exchanged, a worker first removes the screw 102 in the state illustrated in FIGS. 4 and 5. Then, since the connection between the extension roller unit 81 having the tension spring 96 and the tension roller unit 82 is released and a reactive force of the tension spring 96 is not supported via the tension roller unit 82, the tension between the secondary transfer belt 65 and the tension roller 63 is not applied on the side of the anterior end 63*a* of the tension roller 63.

After the worker releases the tension based on the urging force of the tension spring 96 between the secondary transfer belt 65 and the tension roller 63, the worker slides the tension roller unit 82 in the axial direction (a Z direction in FIG. 4), and detaches the fitting portion between the bearing 84 and the posterior end 63*b* of the tension roller 63 (that is, releases the engagement between the bearing 84 and the posterior end 63*b* of the tension roller 63). Thus, the tension force of the posterior side (the left side of FIG. 4) in an extraction direction (the Z direction indicated by the arrow in FIG. 4) occurring due to the urging force of the tension spring 85 is not applied to the tension roller 63 and the secondary transfer belt 65, and thus the posterior end of the tension roller unit 82 becomes disengaged.

Then, even when the worker does not detach and disassemble the constituent elements of the respective units, the worker can easily separate and extract the tension roller unit 82 from the extension roller unit 81 along the guide ribs 94*a* and 94*b* to which the guide grooves 95*a* and 95*b* are fitted, as in FIG. 6, by completely releasing the tension force between the secondary transfer belt 65 and the tension roller 63 by the urging force of the tension springs 85 and 96.

An operational force necessary to detach the fitted portion between the bearing 84 and the posterior end 63*b* of the tension roller 63 is less than a force (that is, a force for moving the tension roller 63 against the urging force of the tension springs 85 and 96) for not applying the tension force from the tension roller 63 to the secondary transfer belt 65. Further, once the posterior end 63*b* of the tension roller 63 is uncoupled from the bearing 84, the urging force from the tension spring 85 does not act on the tension roller unit 82. Further, since the extraction direction is regulated by the guide ribs 94 (94*a* and 94*b*) and the guide grooves 95 (95*a* and 95*b*) guiding the tension roller unit 82 at the time of the extraction from the extension roller unit 81, the tension roller unit 82 can be smoothly extracted from the extension roller unit 81.

The tension springs 85 and 96 are configured to pressurize both ends of the tension roller 63. Therefore, when the worker performs the above-described operation, for example, the worker can press the tension roller 63 on the opposite side to the urging direction to release the tension force simply. Further, a tension releasing portion pushing up the tension roller 63 in a direction against the urging force of the tension spring may be provided in the secondary transfer unit 60. More specifically, for example, the tension releasing portion can be configured by a cam mechanism or the like which can be maintained when the anterior end 63*a* and the posterior end 63*b* of the tension roller 63 are moved against the urging force of the tension springs 85 and 96.

In the embodiment, as illustrated in FIGS. 8A and 8B, unit posture regulation portions 103 and 105 are provided in the posterior side-surface portion 100*b* of the unit housing 100 and a unit posture regulation portion 104 is provided in the anterior side-surface portion 100*a*.

Thus, when the secondary transfer belt unit 80 is postured to be mounted on a mounting surface (postured at the time of the work of extracting or inserting the tension roller unit 82), the guide ribs 94 and the guide grooves 95 properly engage with each other by an urging force by the weight of the tension roller unit 82. Therefore, since the guide ribs 94*a* and 94*b* are reliably guided by the guide grooves 95*a* and 95*b*, the tension roller unit 82 can be operated to be extracted more smoothly.

Accordingly, a smooth mounting operation can be realized merely by loading the guide ribs 94 on the guide grooves 95 without processing the guide grooves 95 (95*a* and 95*b*) and the guide ribs 94 (94*a* and 94*b*) to have a complicated shape such as a shape (for example, a key shape) for prevention of falling.

In the embodiment, when the guide grooves 95 and the guide ribs 94 engage with each other and the posterior end 63*b* of the tension roller 63 is mounted on the bearing 84 so that the extension roller unit 81 and the tension roller unit 82 are integrated inside the secondary transfer belt 65, the following operation can be performed. That is, the tension roller unit 82 is extracted from the secondary transfer belt 65 by separating the posterior end 63*b* from the bearing 84 while sliding the guide ribs 94 in the guide grooves 95, and the secondary transfer belt 65 is further extracted from the extension roller unit 81.

Thus, the tension roller unit 82 can be easily extracted from the extension roller unit 81 and the secondary transfer belt 65 merely by releasing the tension force of the tension roller 63. Therefore, when a belt is exchanged in the secondary transfer belt unit 80 including the secondary transfer belt 65 with a small diameter, it is possible to realize the configuration in which the exchange can be performed in a short time without unnecessarily detaching components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-143575, filed on Jul. 9, 2013, which is hereby incorporated by reference herein in its entirety.

What is claimed is:

1. A belt unit comprising:

a rotary endless belt;

a tension roller extending the endless belt and applying a tension force to the endless belt;

at least one extension roller extending the endless belt with the tension roller;

a first bearing portion supporting a first end of the tension roller such that the first end is movable in a tension direction and is detachably mounted to be able to release the tension force by the first end coming off from the first bearing portion;

a second bearing portion supporting a second end of the tension roller to be movable in the tension direction;

a first urging portion urging the first end of the tension roller and generating the tension force;

a second urging portion urging the second end of the tension roller and generating the tension force;

a first frame portion integrally supporting the first bearing portion, the first urging portion, and the extension roller; and a second frame portion integrally supporting the second bearing portion, the second urging portion, and the tension roller and detachably mounted on the first frame portion.

2. The belt unit according to claim 1, wherein the first frame portion includes a first support member supporting an end of the extension roller opposite to the first bearing portion and, the second frame portion includes a second support member detachably mounted with the first support member and supporting the second end of the tension roller.

3. The belt unit according to claim 1, wherein the first frame portion includes a first guide portion provided along an axial direction of the extension roller, and the second frame portion includes a second guide portion guided along the first guide portion.

4. An image forming apparatus comprising:

an image forming portion configured to form a toner image; and a belt unit according to claim 1 transferring the toner image from the image forming portion to a recording medium.

5. A belt unit comprising:

a rotary endless belt;

a first roller unit disposed in an inside of the endless belt and including an extension roller extending the endless belt; and a second roller unit mounted on the first roller unit and including a tension roller imparting tension to the endless belt, the second roller unit configured to be detachable from the first roller unit by sliding the second roller unit in a sliding direction orthogonal to a rotating direction of the endless belt in a state in which the endless belt is wound around outer peripheries of the first and second roller units.

6. The belt unit according to claim 5, wherein the first roller unit includes a first urging member urging a first end of the tension roller and a first bearing portion supporting the first end of the tension roller to be movable in an urging direction of the first urging member and the sliding direction, wherein the second roller unit includes a second urging member urging a second end of the tension roller, a second bearing portion supporting the second end of the tension roller to be movable in an urging direction of the second urging member, and a connection member connecting the second roller unit to the first roller unit on a side of the second end of the tension roller, and wherein the second roller unit is configured to release a tension force caused by the urging force of the second urging member by disconnecting the connection of the first and second roller unit and the first roller unit is configured to release a tension force caused by the urging force of the first urging member in response to the first end of the tension roller coming off from the first bearing portion by the tension roller being slid in the sliding direction.

* * * * *